US005282316A

United States Patent [19]

Anderson

[11] Patent Number: 5,282,316

[45] Date of Patent: Feb. 1, 1994

[54] HAND HELD RAZOR-CONTAINING CUTTING DEVICE

[75] Inventor: Dennis C. Anderson, Northfield, Minn.

[73] Assignee: National Polymers Inc., Lakeville, Minn.

[21] Appl. No.: 378

[22] Filed: Jan. 4, 1993

[51] Int. Cl.[5] ..... B26B 3/08

[52] U.S. Cl. ..... 30/294; 30/2; 30/125; 30/339

[58] Field of Search ..... 30/294, 278, 280, 282, 30/286, 289, 125, 127, 315, 317, 329, 332, 339, 2; 411/508, 509, 510, 913

[56] References Cited

U.S. PATENT DOCUMENTS

| | | | |
|---|---|---|---|
| 2,254,199 | 9/1941 | Baltuch | 30/289 |
| 2,478,668 | 8/1949 | Shepard et al. | 30/339 |
| 2,681,502 | 6/1954 | Black | 30/2 |
| 2,726,448 | 12/1955 | Smith | 30/286 |
| 3,178,812 | 4/1965 | Lurie | 30/2 |
| 3,257,726 | 6/1966 | Longobardi | 30/339 |
| 4,167,810 | 9/1979 | Gilbert | 30/294 |
| 4,198,751 | 4/1980 | Egbert | 30/286 |
| 4,493,148 | 1/1985 | Ruff | 30/2 |
| 4,570,339 | 2/1986 | Taylor | 30/2 |
| 4,631,829 | 12/1986 | Schmidt et al. | 30/294 |

*Primary Examiner*—Richard K. Seidel
*Assistant Examiner*—Hwei-Siu Payer
*Attorney, Agent, or Firm*—James V. Harmon

[57] ABSTRACT

The invention provides a hand held razor-containing cutting device formed from two separable halves that are connected together during use along a centrally located longitudinally extending parting line. The two halves of the tool are held in contact with one another by means of frictional connecting elements that allow the halves of the tool to snap together for use. A pair of adjacent disassembly tabs are provided. One such tab is located on each half of the tool to facilitate separating the halves of the tool by prying the halves apart, usually with a screwdriver or similar tool that is placed between the tabs and then twisted to pry the tabs away from one another for separating the two portions of the cutting device so that the razor blade can be removed and replaced when required. The frictional connecting elements comprise C-shaped cooperating retaining studs that extend from one half of the tool and during assembly snap into openings provided in the other half.

3 Claims, 2 Drawing Sheets

HAND HELD RAZOR-CONTAINING CUTTING DEVICE

FIELD OF THE INVENTION

The present invention relates to hand held tools and more particularly for a tool for holding a razor blade.

BACKGROUND OF THE INVENTION

Several hand-held tools have been provided for holding a razor blade that is used in cutting articles such as packaging, twine and other products. Some of them, such as that described in U.S. Pat. No. 2,254,199, are made of two halves which separate along a center line extending longitudinally to facilitate removing and replacing the razor blade. The present invention employs resilient retaining studs for holding the two halves of the tool together. In the development of the present invention, it was found quite difficult to separate the two halves of the tool. It is thus an object to find a way of enabling the user to quickly and easily separate the two halves of the tool whenever the blade requires changing.

Another problem concerned replacement blades held inside the tool. There was no way to tell if replacement blades were present. Accordingly, another object of the invention is to provide a feature that allows the user to know whether or not additional blades are available.

A further problem concerned the resiliency of the elastic retaining studs used for holding the two halves together. There is a tendency for the studs to be too rigid. Accordingly, another object is to find a way of making the studs used for releasably locking the two halves of the tool together more resilient and less likely to be damaged during use.

A further object of the invention is to find a way of making the tool economical to produce with a minimum of material but yet to strengthen, rigidify and reinforce the slot and guide the article that is being cut to the razor edge so that it will give good life and not be damaged during use.

These and other more detailed and specific objects of the present invention will be apparent in view of the following description setting forth by way of example but a few of the various forms of the invention that will be apparent to those skilled in the art once the principles described herein are understood.

SUMMARY OF THE INVENTION

The invention provides a hand held razor-containing cutting device formed from two halves that are connected together during use along a parting line, preferably a centrally located longitudinally extending parting line. The two halves of the tool are held in contact with one another by means of frictional retaining elements that allow the halves of the tool to snap together for use. A pair of adjacent cooperating disassembly tabs are provided. One such tab is located on each half of the tool to facilitate separating the halves of the tool by prying the halves apart, for example with a screwdriver or similar tool placed between the tabs and then twisted to pry the tabs apart so as to separate the halves of the cutting device to enable the razor blade to be removed and replaced when required.

In a preferred form of the invention, the halves of the tool are held together by means of frictional retaining elements that comprise a pair of laterally aligned C-shaped cooperating retaining studs that extend from one half of the tool into openings provided in the other half.

The invention will be better understood by reference to the figures which illustrate by way of example one preferred form of the invention.

THE FIGURES

DETAILED DESCRIPTION OF THE INVENTION

Figure 1:
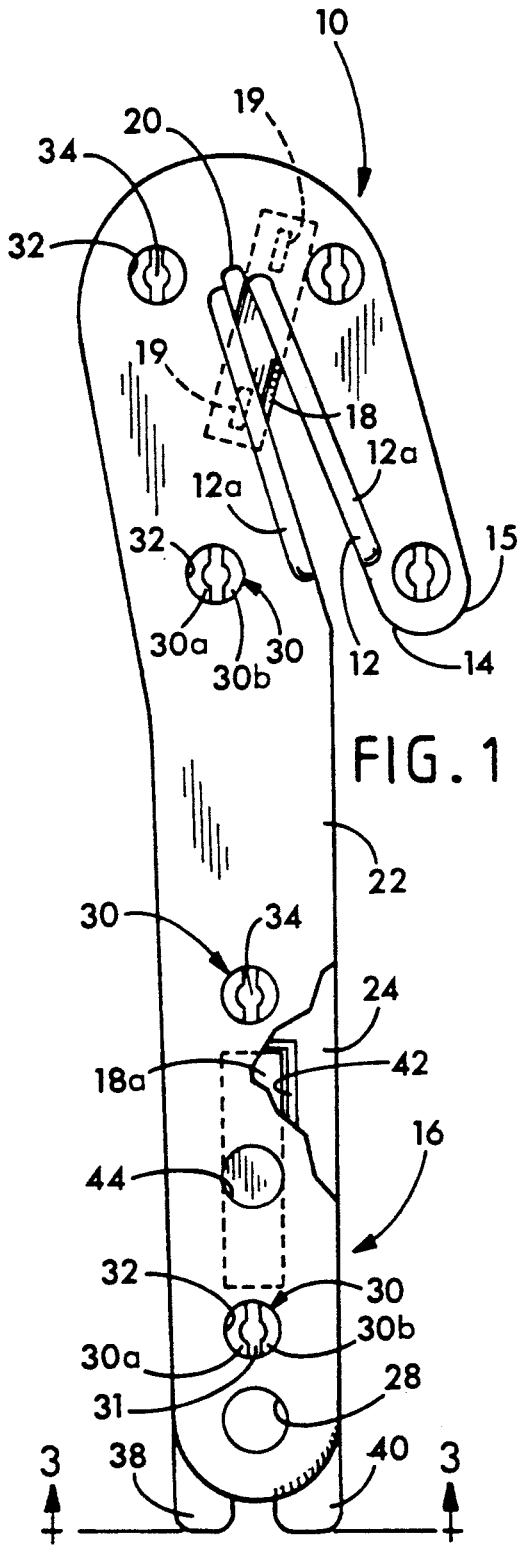
FIG. 1 is a plan view of the tool as seen from the right side.
Figure 2:
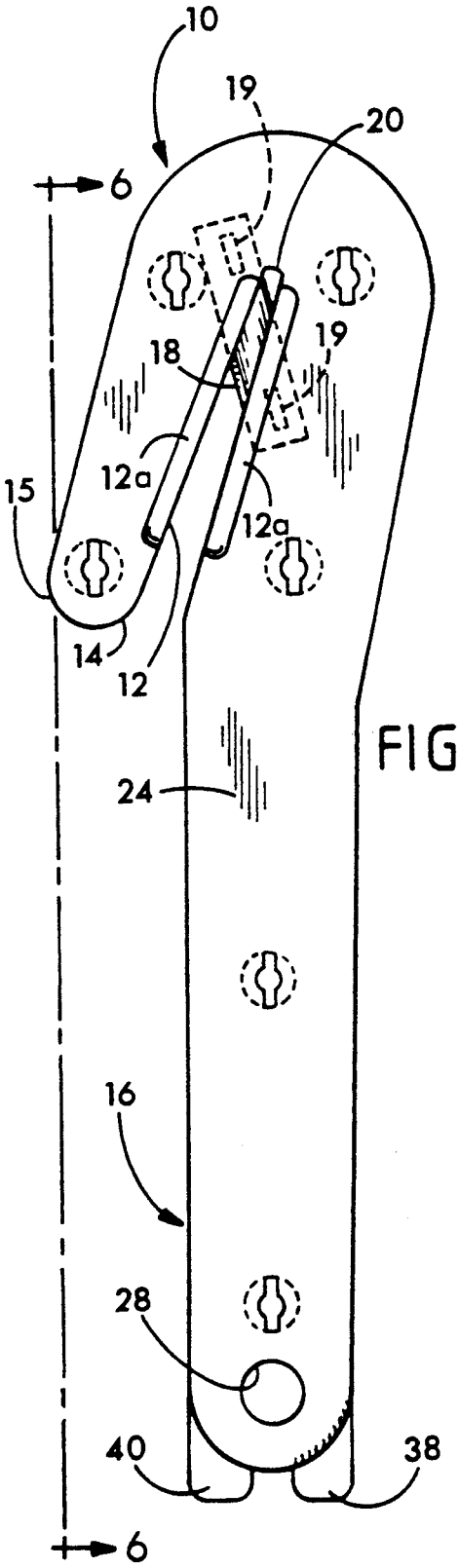
FIG. 2 is a plan view of the tool as seen from the left side.

As seen in FIGS. 1 and 2, the invention provides a hand held razor-containing cutting device 10 having an elongated slot 12 at one end that has an open mouth 14 facing the handle end 16 of the tool and which leads by guiding the article such as piece of twine toward a razor blade 18 that is positioned near a closed end 20 of the slot 12. Adjacent to the mouth 14 of the slot 12 is a rounded nose portion 15 which is placed beneath the piece of twine or other article that is being cut just before it is drawn into the slot 12. It is preferred that reinforcing ribs 12*a* are provided along each edge of the slot 12 to strengthen and rigidify the slot 12 and prevent damage to the slot 12 over extended periods of use.

Figure 3:
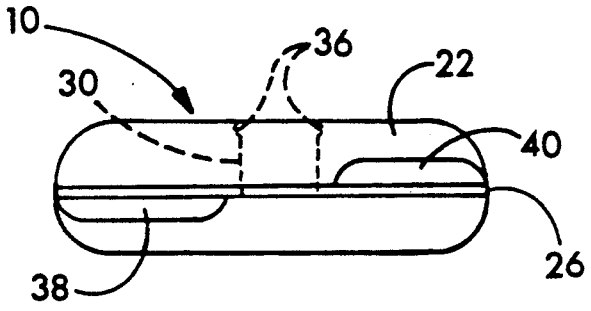
FIG. 3 is an end elevational view of the tool on an enlarged scale taken on line 3—3 of FIG. 1.
Figure 4:
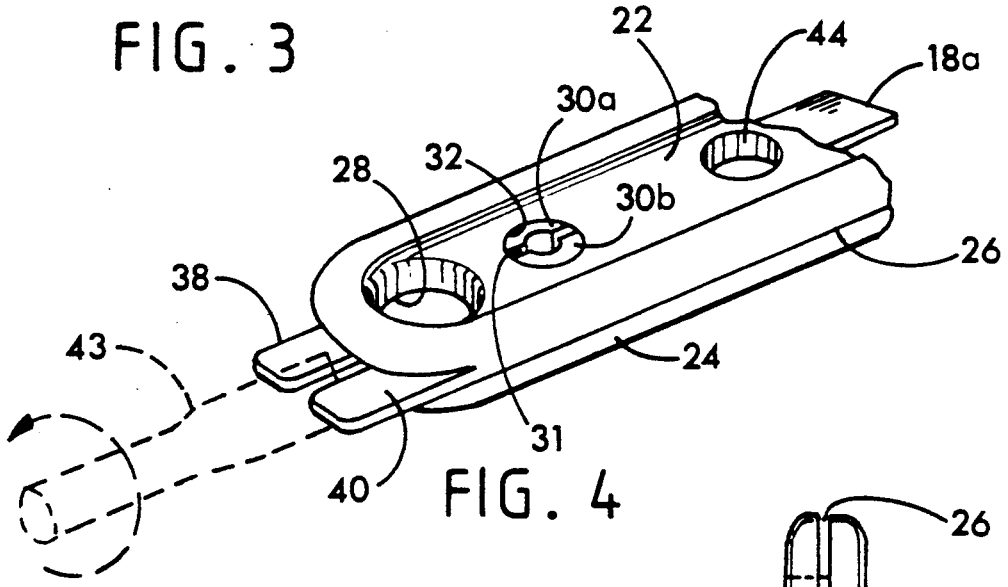
FIG. 4 is a partial perspective view of the end portion of the handle of the tool.
Figure 5:
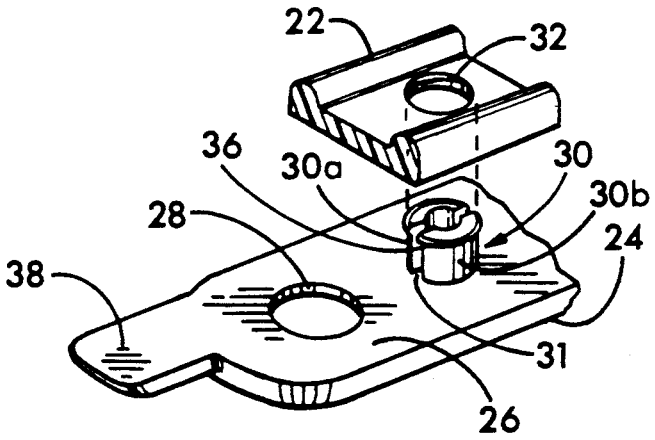
FIG. 5 is a partial exploded perspective view of the end of the handle showing the halves of the device separated from one another.
Figure 6:
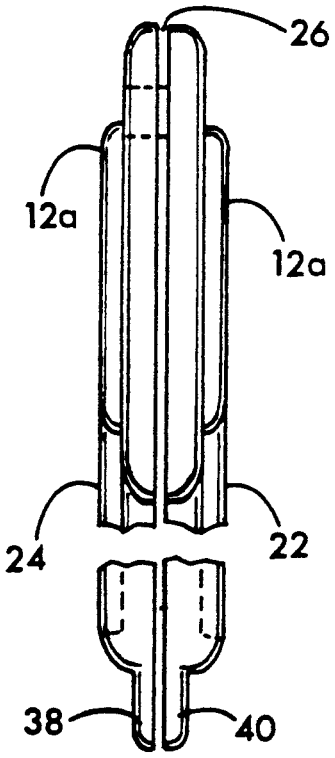
FIG. 6 is an elevational view taken on line 6—6 of FIG. 2.

The razor blade 18 can be held in place in any suitable manner, as by means of a pocket in the inner surface of one of the halves 22, 24 of the device 10 or by means of rectangular studs 19 that project from an adjacent inner surface of one half of the device 10 into an opening in the razor blade 18. The device 10 is composed of two mating portions 22 and 24 which during use are positioned in registration and contact one another along a central longitudinally extending separation line 26 (FIGS. 3, 4 and 6). The device 10 is preferably formed from a strong material such as injection molded plastic resin, e.g. polyethylene, polypropylene, polyvinylchloride, nylon, Delrin ® or the like. The two halves 22, 24 of the device 10 thus enclose almost all of the razor blade 18 except for the portion that is visible within the slot 12 facing the mouth 14 during use, and each half 22, 24 contacts the razor blade 18 on opposite sides. The handle portion 16 of the device 10 can be provided with an opening 28 that extends through both halves 22, 24 for tying the device to a lanyard (not shown) or for hanging it on a hook when not in use.

The two halves 22, 24 of the device 10 are held together by connecting means, in this case a plurality of spaced apart, centrally projecting studs 30 which extend into cylindrical openings 32 in the upper half 22 of the device 10 as seen in FIG. 1. Each of the studs 30 comprises a split cylindrical retaining stud having a central slot 31 and a cylindrical central opening 34 aligned with the center line of the cylindrical stud 30 to provide two laterally spaced apart C-shaped stud halves 30*a* and 30*b*. At the top of each half 30*a*, 30*b* of each stud 30 are provided lateral projections 36 to help lock the halves 22, 24 of the device 10 together when assembled. The central opening 34 which gives each half 30*a*, 30*b* of the stud 30 a C-shaped configuration as seen from the end (FIG. 1) provides the stud 30 with very good resiliency and elasticity so that it can be used repeatedly over long periods of time and yet will hold the device 10 together reliably and with little tendency for the studs 30 to be damaged during use.

At the free or bottom end of the handle portion 16 of the device 10 is provided a pair of adjacent cooperating disassembly tabs 38 and 40. The tab 38 is located on one half 24 and the tab 40 is located on the other half 22 of the device 10. It can be seen that each of the tabs 38, 40 extends downwardly from the free end, i.e. the bottom end of the handle portion 16 of the device 10 as seen in FIGS. 1 and 2 along axes that are aligned generally with a longitudinal axis of the handle portion 16 of the tool 10.

By placing a tool such as a screwdriver 43 or other similar tool (FIG. 4) between the tabs 38, 40 the halves 22, 24 of the device 10 can easily be separated by prying the halves 22, 24 apart. Thus, when the razor blade 18 needs to be changed, the screwdriver 43 is placed between the disassembly tabs 38, 40 and twisted to force the tabs 38, 40 apart, thereby separating the halves 22, 24 of the device 10 for removing and replacing the razor blade 18.

In the handle portion 16 of the cutting device 10 are provided one or more additional, i.e. spare, cutting blades 18*a*. The extra blades 18*a* are held in a chamber 42 aligned with a peephole 44 that allows one to know immediately if spare blades 18*a* are available.

When the blade 18 is worn or damaged after being used, one need only pry the halves 22, 24 apart by placing a tool such as the screwdriver 43 between the disassembly tabs 38, 40 and then twisting the screwdriver, causing the retaining studs 30 to snap out of the openings 32 and allowing the user to remove one of the spare blades 18*a* from the chamber 42 and to replace the blade 18 at the end of the slot 12.

Many variations of the present invention within the scope of the appended claims will be apparent to those skilled in the art once the principles described herein are understood.

What is claimed is:

1. A hand held razor holding cutting device, comprising:

a cutting device body including two mating portions that are secured in registration during use so as to contact one another along a parting line, frictional connecting means operatively associated between the portions of the device for releasably securing the portions of the device in contact with one another, wherein the parting line extends longitudinally and centrally of the device and is located between the mating portions of the device, the connecting means comprise studs projecting from an inside surface of one of said portions and positioned to extend into aligned openings provided within the other portion of the device, each of said studs comprises a split cylindrical connecting stud with a centrally located slot and a cylindrical center opening aligned with a center line of the stud to provide two laterally paced apart C-shaped stud halves, said device having a razor blade receiving means for holding a razor blade between the portions of the device with a part of the blade exposed for cutting objects, and a pair of adjacent cooperating disassembly tabs, one such tab being located on each portion of the device to facilitate separating the portions of the device by prying the tabs to force the tabs apart and thereby separate the portions of the device from one another for removing and replacing said razor blade.

2. A hand held razor holding cutting device, comprising:

a cutting device body including two mating halves that are in registration during use so as to contact one another along a parting line, frictional connecting means operatively associated between the halves of the device for releasably securing the halves of the device in contact with one another, said device having a razor blade holding means for holding a razor blade between the halves of the device with a portion of said blade exposed for cutting objects, a pair of adjacent cooperating disassembly tabs, one such tab being located on each half of the device to facilitate separating the halves of the device by prying the tabs apart so as to force the tabs away from one another and thereby separate the halves of the device for removing and replacing said razor blade, wherein the parting line extends longitudinally and centrally of the device and is located between the halves of the device, the connecting means comprise centrally extending studs on one of said halves of the device positioned to extend into aligned openings provided on the other of said halves of the device, each of said studs comprises a split cylindrical retaining stud having a cylindrical center opening aligned with a center line of each stud to provide two laterally spaced apart C-shaped stud portions, lower parts of said mating halves form an elongated handle and each of said disassembly tabs extends downwardly from a bottom end of said handle along an axis aligned with a longitudinal axis of the handle, and the device has a slot for guiding articles toward the razor blade, and a reinforcing rib is provided on an edge of said slot for reinforcing the slot and to help in guiding an article that is being cut through the slot toward the razor blade.

3. The hand held cutting device of claim 2 wherein the device includes a chamber formed between said mating halves for holding replacement razor blades and a peephole is provided in at least one of the halves of the cutting device to enable a user to see whether or not replacement blades are contained within the cutting device.

* * * * *